US007494124B2

(12) United States Patent
Hole

(10) Patent No.: US 7,494,124 B2
(45) Date of Patent: Feb. 24, 2009

(54) MULTIPLICITY OF DICE BOARDLESS GAME

(75) Inventor: Debbie Hole, 9160 NW. 15th St., Plantation, FL (US) 33322

(73) Assignee: Debbie Hole, Plantation, FL (US)

( * ) Notice: Subject to any disclaimer, the term of this patent is extended or adjusted under 35 U.S.C. 154(b) by 0 days.

(21) Appl. No.: 11/710,361

(22) Filed: Feb. 26, 2007

(65) Prior Publication Data

US 2008/0203657 A1 Aug. 28, 2008

(51) Int. Cl.
*A63F 3/00* (2006.01)

(52) U.S. Cl. ..... 273/146; 273/274

(58) Field of Classification Search ..... 273/146, 273/309, 274, 139; 463/16, 22
See application file for complete search history.

(56) References Cited

U.S. PATENT DOCUMENTS 4,648,602 A * 3/1987 Maroney ..... 273/146
4,930,780 A * 6/1990 Goodman et al. ..... 273/146
5,558,328 A * 9/1996 Krantz ..... 273/146

* cited by examiner

*Primary Examiner*—Vishu K. Mendiratta
(74) *Attorney, Agent, or Firm*—Robert J. van Der Wall

(57) ABSTRACT

The invention is a game for two or more players comprised of twelve dice, a cup for shaking and rolling the dice, a score card and game instructions/rules of play. In each round of preferably nine rounds each player in sequence can roll the dice up to three times to complete the dice combination called for in the rules for that given round, referred to as a round goal. When a player achieves a round goal, scoring is based upon the count of the face numbers on the three or more dice required to complete the round goal. A player that fails to achieve the round goal in a particular round scores a zero if that objective is not achieved in three rolls of the dice. The rules provide for the number of dice to be rolled in each round.

14 Claims, 2 Drawing Sheets

| | Round 1 4 Dice | Round 2 5 Dice | Round 3 6 Dice | Round 4 7 Dice | Round 5 8 Dice | Round 6 9 Dice | Round 7 10 Dice | Round 8 11 Dice | Round 9 12 Dice | Total Score |
|---|---|---|---|---|---|---|---|---|---|---|
| Player | 3 of a Kind | 4 of a Kind | Run of 5 | 2 Sets of 3 | 1 Set of 3 1 Run of 4 | 2 Runs of 4 | 3 Sets of 3 | 1 Run of 6 1 Set of 4 | 3 Runs of 4 | |
| | | | | | | | | | | |
| | | | | | | | | | | |
| | | | | | | | | | | |
| | | | | | | | | | | |
| | | | | | | | | | | |
| | | | | | | | | | | |
| | | | | | | | | | | |

20

| | Round 1<br>4 Dice | Round 2<br>5 Dice | Round 3<br>6 Dice | Round 4<br>7 Dice | Round 5<br>8 Dice | Round 6<br>9 Dice | Round 7<br>10 Dice | Round 8<br>11 Dice | Round 9<br>12 Dice | Total Score |
|---|---|---|---|---|---|---|---|---|---|---|
| Player | 3 of a Kind | 4 of a Kind | Run of 5 | 2 Sets of 3 | 1 Set of 3<br>1 Run of 4 | 2 Runs of 4 | 3 Sets of 3 | 1 Run of 6<br>1 Set of 4 | 3 Runs of 4 | |
| | | | | | | | | | | |
| | | | | | | | | | | |
| | | | | | | | | | | |
| | | | | | | | | | | |
| | | | | | | | | | | |
| | | | | | | | | | | |
| | | | | | | | | | | |

FIG. 4

20

MULTIPLICITY OF DICE BOARDLESS GAME

BACKGROUND OF THE INVENTION

1. Field of the Invention

The present invention relates to the field of games, and more specifically, concerns a game involving a multiplicity of dice, a cup for shaking and rolling dice, a score card, and a set of game instructions and rules of play. The game does not include a board, being generally played on a flat level surface such as a table top. The invention contemplates both the method of playing the game and the apparatus for doing so. The method is embodied in the game instructions and rules of play. The dice and cup can be replaced by any convenient random number selector(s).

2. Description of the Prior Art

The use of games as pastimes is very old in the human experience. Most games involve the interaction of two or more players such as chess or checkers, although a few such as solitaire can be played by a single individual. Most games involve the use of a playing board, such as chess or checkers or Monopoly, but some do not require a board. An example of the later is Hochstim, U.S. Pat. No. 4,674,753 for a boardless maze game. A few require a specific habitat such as Van Der Mude, U.S. Pat. No. 5,560,615 for a Fishing Game on Managed Habitat. Others require specific equipment such as Moore, Jr., U.S. Pat. No. 6,213,876 for a Method of Playing Dice Game, Mannarino, U.S. Pat. No. 4,205,465 for Occularmotor Educational Device, and Barnes et al., U.S. Pat. No. 4,961,581 for Apparatus for Playing a Game. Others require specialized boards such as Fratangelo et al., U.S. Pat. No. 5,020,805 for War Game, and Mooney, U.S. Pat. No. 5,318,447 for Multiplication Square Game and Method.

In contrast, the present invention is a game that is a paragon of simplicity since it does not require a playing board, any specialized equipment or tokens. It preferably comprises twelve dice which can be either of the conventional type having one through six spots on each of its six faces of a cube or can have other indicia thereon indicating a series of sequential Arabic numbers such as one through six. The game may be played with two or more people and uses a score card that is kept by a designated score keeper/player who is also the first player in the sequence. The object is to achieve a series of sets and runs in accordance with rules through a plurality of rounds, preferably nine rounds. A set is defined as three or more dice having the same number while a run is defined as four or more dice in consecutive numerical order.

SUMMARY OF THE INVENTION

Bearing in mind the foregoing, it is a principal object of the present invention to provide a pastime in the form of a game to be played by two or more players which is a paragon of simplicity requiring only a multiplicity of dice, a dice cup, a score sheet, and rules of play.

A related principal object of the invention is to provide a pastime game which eliminates the need for a playing board or for elaborate auxiliary equipment.

Another advantage of the invention is to reduce the storage space for a game or a box that must be maintained in good condition to avoid loss of game components.

A further object of the invention is to provide a game that is extremely economical to manufacture thereby making it amenable to a low purchase price and/or a larger profit margin.

An additional object of the invention is to provide a game comprised of readily available components so that if any parts are misplaced they may be readily replaced without the necessity to go back to the manufacturer.

Other objects and advantages will be apparent to those skilled in the art upon reference to the following descriptions and the appended claims.

In accordance with a major aspect to the invention there is provided a game for two or more players comprised of twelve dice with sequential numbers or numbers of dots on each of the preferably six faces of each die, a cup for shaking and rolling the dice, a score card and game instructions/rules of play. A score keeper is appointed and is the first of the sequential players to roll the dice. In each round of preferably nine rounds each player in sequence can roll the dice up to three times to complete the dice combination called for in the rules for that given round, referred to as a round goal. When a player achieves a round goal, scoring is based upon the count of the face numbers on the three or more dice required to complete the round goal. A player that fails to achieve the round goal in a particular round scores a zero if that objective is not achieved in three rolls of the dice. The rules provide for the number of dice to be rolled in each round is always one more than the number needed for the round goal, except for the final round. If the extra die results in adding to or extending a set or run the score achieved is not only the additional number on the face of the additional die, but also a bonus number of points. The specifics of the rules concerning the objectives of each round are contained in the detailed description of the preferred embodiment that follows. The invention contemplates that the dice and cup may be replaced by any convenient random number selector(s).

BRIEF DESCRIPTION OF THE DRAWINGS

FIG. 4 shows the preferred embodiment of the score card, showing in summary terms the requirements of each round, and the preferred embodiment thereof.

DETAILED DESCRIPTION OF THE PREFERRED EMBODIMENTS

As required, a detailed embodiment of the present invention is disclosed herein; however, it is to be understood that the disclosed embodiments is merely exemplary of the invention which may be embodied in various forms, particularly by revision to the game instructions and rules of play. Therefore, specific structural and functional details disclosed herein are not to be interpreted as limiting, but merely as the basis for the claims and as a representative basis for teaching one skilled in the art to variously employ the present invention in virtually any appropriately detailed structure.

Figure 1:
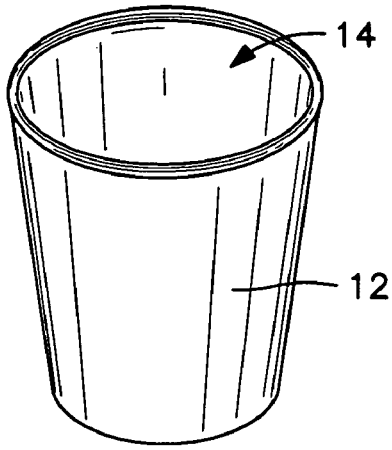
FIG. 1 shows a cup for shaking and rolling dice. The player's hand is held over the cup opening when the cup is shaken to mix up and randomly rotate the dice before rolling them.

FIG. 1 shows a cup 12 for shaking and rolling dice. The player's hand is held over the cup opening 14 when the cup 12 is shaken to mix up and randomly rotate the dice before rolling them.

Figure 2:
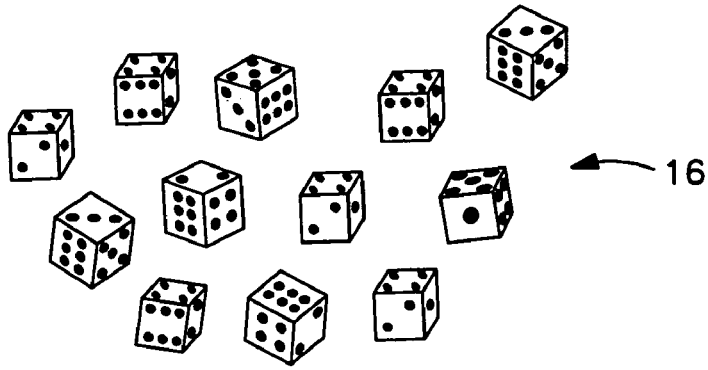
FIG. 2 shows a multiplicity of dice which are used in whole or in part as set forth in the detailed description of the preferred embodiments.

FIG. 2 shows twelve (12) dice 16 which are used in whole or in part as set forth hereinafter.

Figure 3:
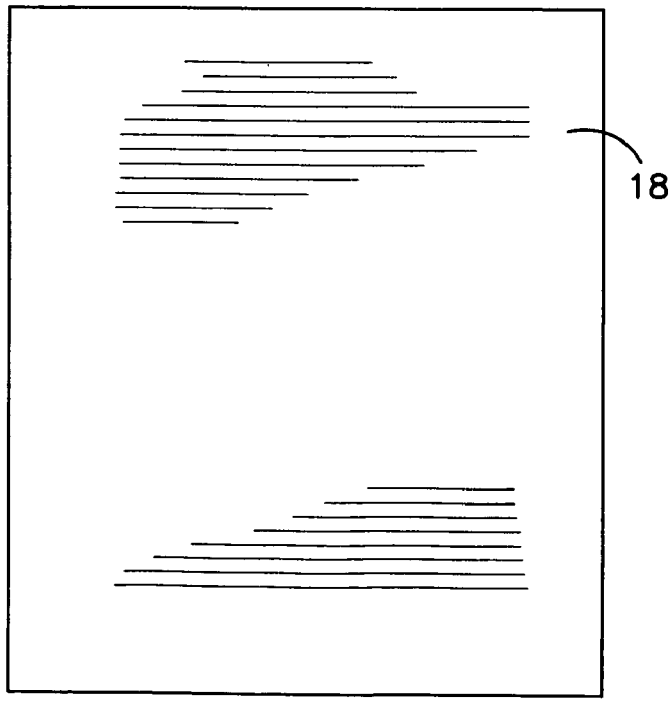
FIG. 3 shows a graphical representation of the game instructions and rules of play, as set forth in the detailed description of the preferred embodiments.

FIG. 3 shows a graphical representation of the game instructions and rules of play 18, as set forth hereinafter.

FIG. 4 shows the preferred embodiment of the score card 20, showing in summary terms the requirements of each round in the preferred embodiment.

The object of the game is to roll various combinations of the dice to get the highest score through a series of rounds, preferably nine (9) rounds. Scoring is achieved by counting the spots (or adding the numbers if dice without spots are used or another random number selector(s) is/are used) on dice that form sets and runs that successfully comply with the game instructions and rules of play, termed round goals. Bonus points (points equal spots or numbers on dice) are awarded when the extra die extends the set or run beyond the minimum requirement for same. There is also a super bonus that only applies in round nine. A set is defined as three (3) or more dice of the same number. A run is defined as four (4) or more dice in consecutive order.

The game is intended to be played by two or more players. Players take turns rolling the dice. To start the game, a score keeper is selected, and the score keeper has the first turn. The second player is to the left of the score keeper and so on. Each player's turn is comprised of up to three (3) rolls of the dice in order to obtain the dice combination required by the game instructions and rules of play for each given round, i.e., a round goal. Each roll of the dice in every round uses one more die than is required for the dice combination in a given round with the exception of the final ninth round, in which the player uses all the dice to make the round combination. If none of the players get the combination required on the first round, then the round repeats until someone scores in that round. For example, if there are 5 people playing and no one gets the dice combination for the round, the round continues with the score keeper as the first player again.

The rules require that all players must receive the same number of turns per round. For example, assume that the score keeper does not score, then the second player does not score, but the third player makes the required combination for the round. The fourth and fifth players take their turn and complete the round.

Score is kept on the score card 20. On each score card 20 there is a column of boxes that show each dice combination for each round and provide a place for each player's score. To score, add the face value of only the dice that make up that dice combination required for that round. If no score is obtained, the box is left blank or a zero is entered and the dice passed to next person.

First Roll—The number of dice needed for the round goal are rolled plus one extra die. If any one or more of the dice show a face required for the set or run of required combination in a given round, it may be set aside for the next of the three rolls in a given player's turn in any round. Those dice that are set aside are referred to as "keepers." If on the first roll, the player has made the round goal, the face value of those dice that complete round goal are added up, but not the one extra die unless it qualifies for the bonus by extending the combination required for the round. If the round goal has not been achieved on the first roll of the dice, the player continues to roll up to three times to try to get the combination needed, the round goal. If the player does not achieve the round goal in a given turn, a zero is scored for that player for that round. Once the player's score is tallied, the dice and cup are then passed on to the next player.

Second Roll—The remaining dice from the first roll if the player chooses or all dice needed for the round goal are rolled. The player may aside any keepers and roll a third time. If the player does not achieve the round goal, he or she rolls again. After the second roll, if the player makes the round goal, the face value of those dice that complete the round goal are added up, but not the one extra die unless it qualifies for the bonus by extending the combination required for the round. Once the player's score is tallied, the dice are then passed onto the next player.

Third Roll—The remaining dice or all dice needed for the round goal from the second roll are rolled if the player chooses. After the third roll, if the player makes his or her round goal the face value of those dice is added up, but not the one extra die unless it qualifies for the bonus by extending the combination required for the round.

The preferred embodiment of the definition of the rounds now follows:

Round One—(One Set of Three of a Kind)

Using four (4) dice each player attempts to roll three (3) of a kind. If the round combination is made with the number three (i.e. 3-threes), add the face value of the three (3) dice (for a total of nine). If a player should roll four (4) of a kind the player will add the score of the fourth die their score plus an extra 10 bonus points for using all the dice in their round combination.

Example:

3+3+3=9 points

3+3+3+3+10 bonus=22 points

Round Two—(One Set of Four of a Kind)

Use five (5) dice to try to roll four (4) of a kind. Follow the same scoring as in round one. Add the face value of all dice plus 10 bonus points if the player uses all the dice in the round combination.

Example:

6+6+6+6=24 points

6+6+6+6+6+10 bonus=40 points

Round Three—(A Run of Five Numbers)

Use six (6) dice to make a combination of five (5) consecutive numbers. It can be either 1-2-3-4-5 or 2-3-4-5-6. If the player gets the run, the face value of the run is added up for the score. Add the face value of all the dice plus 10 points if the player uses all the dice in the round combination.

Example:

1+2+3+4+5=15 points

1+2+3+4+5+6+10 bonus=31 points

Round Four—(Two Sets of Three of a Kind)

Seven (7) dice are used to get two sets of three dice, each set having all the same number. The face value of the dice is totalled for the player's score. The face value of all the dice is added plus 10 points if the player uses all the dice in the round combination.

Example:

2+2+2=6 points

4+4+4=12(+4+10 bonus)=26 points

Total for round=18 or 32 (with bonus)

OR

4+4+4=12 points

2+2+2=6(+2+10 bonus)=18 points

Total for round=18 or 30 (with bonus)

Round Five—(One Set of Three of a Kind and One Run of Four Numbers)

Eight (8) dice to get a set of three and a run of four are used. For this round a set is defined as three (3) dice of the same number. A run is defined as a minimum of four (4) dice in consecutive order. The face value of the dice is totaled for the player's score. The face value of all the dice plus 10 points is totaled if the player uses all the dice in the round combination.

Example:

5+5+5=15 points

2+3+4+5=14(+6+10 bonus)=30 points

Total for round=29 or 45 (with bonus)

OR

5+5+5=15(+5+10 bonus)=30 points

2+3+4+5=14 points

Total for round=29 or 44 (with bonus)

Round Six—(Two Runs of Four Numbers Each)

Nine (9) dice are used to get two runs of four dice each. The face value of the dice are totalled for the player's score. The face value of all the dice are added plus 10 points if the player uses all the dice in the round combination.

Example:

1+2+3+4=10 points

2+3+4+5=14(+6+10 bonus)=30 points

Total for round=24 or 40 (with bonus)

OR

1+2+3+4=10(+5+10 bonus)=15 points

2+3+4+5=14

Total for round=24 or 29 (with bonus)

Round Seven—(Three Sets of Three of a Kind)

Ten (10) dice are used to get three sets of three dice, each set having all the same number. The face value of the dice is totalled for the player's score. The face value of all the dice is added plus 10 points if the player uses all the dice in the round combination.

Example:

1+1+1=3 points

2+2+2=6 points

4+4+4=12(+4+10 bonus)=26 points 21 points (without using all dice and bonus)

Total for round=21 or 35 (using all the dice plus bonus)

OR

1+1+1=3(+1+10 bonus)=14 points

2+2+2=6 points

4+4+4=12 points 21 points (without using all dice and bonus)

Total for round=21 or 32 (using all the dice plus bonus)

OR

1+1+1=3 points

2+2+2=6(+2+10 bonus)=18

4+4+4=12 points 21 points (without using all dice and bonus)

Total for round=21 or 33 (using all the dice plus bonus)

Round Eight—(One Run of Six Numbers and One Set of Four of a Kind)

Eleven (11) dice are used to get one run of six (6) consecutive numbers on the dice and a set of four (4) dice of the same number. The face value of the dice is totalled for the player's score. The face value of all the dice is added plus 10 points if the player uses all the dice in the round combination.

Example:

1+2+3+4+5+6=21 points

1+1+1+1=4(+1+10 bonus)=15 points 25 points (without using all dice and bonus)

Total for round=25 or 36 (using all the dice plus bonus)

Round Nine—(Three Runs of Four Numbers Each)

All twelve (12) dice are used to make three (3) runs of four (4) dice each. A run is four (4) dice in consecutive order. There is a super bonus of 25 points if a player rolls the three runs using all the dice in the first roll. The super bonus only applies to round nine. The face value of the dice is totalled for the player's score.

Example:

1+2+3+4=10 points

1+2+3+4=10 points

1+2+3+4=10 points 30 points

+25 (bonus points for using all the dice on the first roll)

Total for round=55 (total of all dice plus bonus)

Once all the rounds have been played and at least one person has scored for each round, then each player's score is tallied for all nine rounds. The highest total wins the game. If there is a tie score at the end of the nine rounds then the players who tie have one roll of three dice each. The player with the highest total of all three dice is the winner of the game. Should the roll off end in a tie, players roll again with the highest score after the tie breaker being the winner, and so on if necessary.

One option is to shorten the time it takes to play the game by limiting each player to three turns to achieve the round goal in any round. This means that if no player achieved a round goal in a given round and the round was repeated, and then the same thing occurred, replaying the round would only occur twice. After three attempts at playing a round with no player achieving the round goal, each player would be scored the default number, preferably a zero. Then play would go on to either the next round, or completion of the game if the foregoing occurred in the final round.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested in the teachings therein are particularly reserved especially as they fall within the breadth and scope of the claims here appended.

In particular, the invention contemplates that players may modify the round goals, the number of rounds, the number of dice used, the replacement of the dice with any convenient random number selector(s), and the like. Accordingly, many of the appended claims reflect that reality, and are therefore more general than the foregoing rules of play would permit.

What is claimed is:

1. A method of playing a boardless game for more than one player comprising:

adopting a series of rounds in which each round is defined by a round goal in the form of at least one of sets and runs;

in each round each player taking a turn employing a multiplicity of dice up to a defined plurality of times to achieve a round goal wherein the number of dice rolled in a given round is always one more than required to achieve the round goal except in the last round in which all dice are used;

scoring a default number for each player in a round that fails to achieve the round goal;

totalling the numbers determined by the multiplicity of dice when a round goal is achieved by a player as that player's score for that round;

totalling each player's score from all rounds, the player having the highest score becoming the game's winner.

2. The method of claim 1 which further comprises a cup in which to randomize and roll the dice.

3. The method of claim 1 which further comprises ascertaining that each player has a turn in each round regardless of how many other players have achieved the round goal.

4. The method of claim 1 which further comprises replaying any round if no player achieved the round goal.

5. The method of claim 4 in which the round is optionally only replayed twice so that after three failed attempts for each player to achieve round goal, all of the players would be scored a default number.

6. The method of claim 1 in which the defined plurality of times is preferably three times.

7. The method of claim 1 in which default number is preferably zero.

8. The method of claim 1 which further comprises scoring bonus points if a player exceeds the round goal using the one more die.

9. The method of claim 8 in which the bonus points are ten.

10. The method of claim 1 which further comprises breaking a tie at the end of the game by each of the tied players rolling three dice together with the highest combination of numbers becoming the winner.

11. The method of claim 1 in which a set is at least three of a given number and a run is at least four consecutive numbers.

12. The method of claim 11 in which nine rounds are adopted and the round goals are defined as follows:

round one is one set of three of a kind;

round two is one set of four of a kind;

round three is a run of five numbers;

round four is two sets of three of a kind;

round five is one set of three of a kind and one run of four numbers;

round six is two runs of four numbers each;

round seven is three sets of three of a kind;

round eight is one run of six numbers and one set of four of a kind; and round nine is three runs of four numbers each.

13. The method of claim 12 in which the multiplicity of dice is twelve dice and which method further comprises scoring a player a super bonus who is able to use of all of the dice to achieve the round goal of round nine on the first roll of the dice.

14. The method of claim 13 in which the super bonus is twenty-five points.

* * * * *